US008561231B2

(12) United States Patent
Brenner

(10) Patent No.: US 8,561,231 B2
(45) **Date of Patent: *Oct. 22, 2013**

(54) LEG ELEVATING DEVICE, SYSTEM, AND METHOD

(76) Inventor: Timothy Brenner, Bloomington, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/584,289

(22) Filed: Aug. 13, 2012

(65) Prior Publication Data

US 2012/0306255 A1 Dec. 6, 2012

Related U.S. Application Data

(63) Continuation of application No. 12/587,769, filed on Oct. 13, 2009, now Pat. No. 8,239,988, which is a continuation-in-part of application No. 11/581,288, filed on Oct. 16, 2006, now abandoned.

(51) Int. Cl.
*A47C 17/86* (2006.01)

(52) U.S. Cl.
USPC ..... 5/648

(58) Field of Classification Search
USPC ..... 5/88.1, 610, 614, 624, 648
See application file for complete search history.

(56) References Cited

U.S. PATENT DOCUMENTS

| | | | |
|---|---|---|---|
| 3,611,452 | A | 10/1971 | Turko et al. |
| 3,611,453 | A | 10/1971 | Lokken |
| 3,739,406 | A | 6/1973 | Koetter |
| 5,181,288 | A | 1/1993 | Heaton et al. |
| 5,316,370 | A | 5/1994 | Newman |
| 5,613,255 | A | 3/1997 | Bish et al. |
| 5,636,394 | A | 6/1997 | Bartley |
| 5,740,997 | A | 4/1998 | Van Wieran |
| 6,421,854 | B1 | 7/2002 | Heimbrock |
| 6,516,479 | B1 | 2/2003 | Barbour |
| 6,575,052 | B2 | 6/2003 | Toennesland et al. |
| 6,615,430 | B2 | 9/2003 | Heimbrock |
| 6,691,349 | B2 | 2/2004 | Blevins |
| 6,701,554 | B2 | 3/2004 | Heimbrock |
| 6,772,460 | B2 | 8/2004 | Heimbrock et al. |
| 6,820,294 | B2 | 11/2004 | Shiery et al. |
| 6,823,541 | B2 | 11/2004 | Egan |

(Continued)

FOREIGN PATENT DOCUMENTS

| | | | |
|---|---|---|---|
| DE | 3737410 | A1 | 5/1989 |
| EP | 0576924 | A1 | 1/1994 |

OTHER PUBLICATIONS

Amcar Motors Corp., Conversion Packages, http://www.amcarmotors.com, 3 pgs, Accessed Oct. 16, 2006.

(Continued)

*Primary Examiner* — Gilbert Lee
(74) *Attorney, Agent, or Firm* — Brooks, Cameron & Huebsch

(57) ABSTRACT

The present disclosure describes devices, methods, and systems for leg elevation. The leg elevating device includes a leg support platform, a base platform positioned adjacent the leg support platform, and a first and second lift positioned between and coupled to the leg support platform and the base platform. The leg support platform can have a first horizontal position relative the base platform when the first and second lift are in a first position, an angled position relative the base platform when the first lift is in a second position and the second lift is in the first position, and a second horizontal position relative the base platform when the first and second lift are in a second position. Also, the leg support platform can be a predetermined height above a floor surface when in the first horizontal position, such that the leg elevating device is locatable under furniture.

20 Claims, 7 Drawing Sheets

(56) References Cited

U.S. PATENT DOCUMENTS

| | | | |
|---|---|---|---|
| 6,941,594 | B1 | 9/2005 | Mosley |
| 6,976,698 | B2 | 12/2005 | Kuiken |
| 6,983,501 | B2 | 1/2006 | Heimbrock et al. |
| 7,000,272 | B2 | 2/2006 | Allen et al. |
| 7,014,264 | B2 | 3/2006 | Alderman et al. |
| D521,301 | S | 5/2006 | Dickson |
| 7,082,630 | B2 | 8/2006 | Castonguay et al. |
| 2002/0104164 | A1 | 8/2002 | Heimbrock |
| 2003/0196268 | A1 | 10/2003 | Heimbrock |
| 2008/0086820 | A1 | 4/2008 | Brenner |

OTHER PUBLICATIONS

Amsvans, Inc, Adaptive Mobility Systems, http://www.amvans.com/?page=conversionDimConsumer, 1 pg, Accessed Oct. 16, 2006.

Handicap Vehicle Specialists, Wheelchair & Scooter Lifts, Single Post Lift, http://www.handicapvehicle.com/Occupied_lifts.html, 10 pgs, Accessed Oct. 13, 2006.

All-WaysAccessible, Bathtub Lifts, http://www.all-waysaccessible.com/bathtub_lifts.htm, 2 pgs, Accessed Oct. 13, 2006.

Heliohealth, Self Powered Lifting Commode Assist, http://www.healiohealth.com/tek9.asp?pg=products&specific=jqpnqqj8, 4 pgs, Accessed Oct. 13, 2006.

American Discount Home Medical Equipment, Invacare Patient Lifts, http:home-med-equip.com/patient-lift/, 7 pgs, Accessed Oct. 13, 2006.

Planet Mobility, Showroom, http://www.planetmobility.com/store/seating/uplift/index.html, 18 pgs, Accessed Oct. 13, 2006.

Nordic Rehab, Capella 201, http://www.nordicrehab.com/nordic_capella201.htm, 4 pgs, Accessed Oct. 13, 2006.

Disability Products, Bath Aids & Toilet Aids, http://www.disabilityproducts.com, 14 pgs, Accessed Oct. 13, 2006.

Disability Products, Help at Home/ Driving http://www.disabilityproducts.com, 13 pgs, Accessed Oct. 13, 2006.

Uplift Technologies Inc., Upeasy Power Seat http://www.upeasy.com, 2 pgs, Accessed Oct. 16, 2006.

LEG ELEVATING DEVICE, SYSTEM, AND METHOD

CROSS-REFERENCE TO RELATED APPLICATION

This present patent application is a continuation of U.S. application Ser. No. 12/587,769, filed Oct. 13, 2009, which is a continuation in part of U.S. application Ser. No. 11/581,288, filed Oct. 16, 2006, the entire specification of which is incorporated herein by reference.

FIELD OF THE DISCLOSURE

The present disclosure relates generally to leg elevating devices, systems, and methods, in particular, a device, system, or method to elevate the legs from an angled position to a horizontal position.

BACKGROUND

Movement of limbs can be challenging for persons with disabilities, the elderly, or persons recovering from recent surgery when those persons transfer from one location to another, whether independently or assisted. For example, in the case of persons with mobility impairments, it is often quite difficult to get into and out of a bed without assistance.

Several efforts have been made to alleviate the problem associated with getting into and out of a bed without assistance. For example, devices equipped with a hoop and pulley-system have been developed so that a person can put their feet into the hoop and pull their legs to bed level. Similar devices are also available where the hoop is attached to a rod so that the person can put their foot into the hoop and pull the rod up so that the foot is level with the bed. These devices, however, have drawbacks such as limited portability in the case of the pulley system, and limited physical capabilities of the person operating the device in the case of the rod and hoop system. Additionally, in both cases the devices require upper and lower body strength to pull the legs upwards to bed level. In cases where persons are disabled or recovering from recent surgery, the persons may not have the strength necessary to operate the devices.

Accordingly, it would be desirable to provide a portable leg elevating device for lifting the legs of a person without requiring substantial upper and lower body strength.

DETAILED DESCRIPTION

Figure 1A:
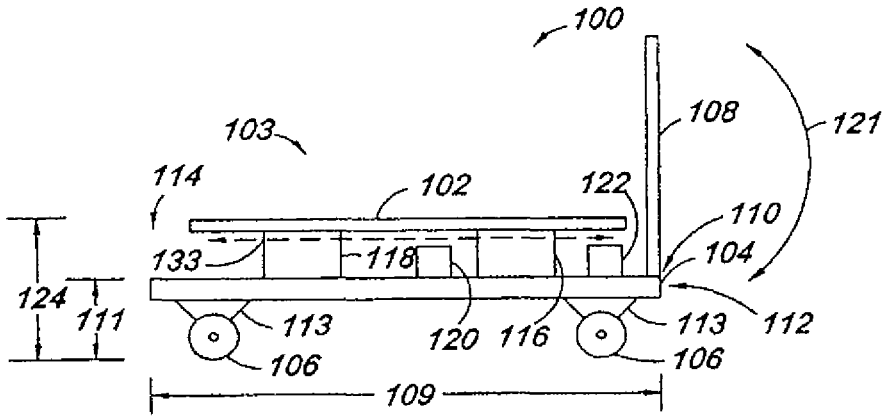
FIGS. 1A-1C and 1E illustrate a plan view of one embodiment of the present disclosure.

For persons with disabilities, it is often difficult to get into and out of a bed without assistance. In particular, it can be difficult for a person to lift their legs into the bed when that person has limited upper and lower body strength. Embodiments of the present disclosure provide various devices, methods, and systems for elevating the legs of an individual to assist the individual when getting into and out of a bed.

In some embodiments, a leg elevating device includes a leg support platform, a base platform, and a first and second lift. In such embodiments the base platform can be positioned adjacent the leg support platform and the first and second lift can be positioned between and coupled to the leg support platform and the base platform. In addition, in various embodiments the leg support platform can have a first horizontal position relative the base platform when the first lift and second lift are in a first position, an angled position relative the base platform when the first lift is in a second position and the second lift is in the first position, and a second horizontal position relative the base platform when the first lift and second lift are in the second position. Also, the leg elevating device can move between the first horizontal position, the angled position, and the second horizontal position such that while in the first horizontal position, the leg support platform can be at a predetermined height above a floor surface such that the leg elevating device is locatable under furniture.

Embodiments of the present disclosure will now be described in relation to the accompanying drawings, which will at least assist in illustrating the various features of the various embodiments.

In the Figures, the first digit of a reference number refers to the Figure in which it is used, while the remaining two digits of the reference number refer to the same or equivalent parts of embodiment(s) of the present disclosure used throughout the several figures of the drawing. The scaling of the figures does not represent precise dimensions and/or dimensional ratios of the various elements illustrated herein.

Figure 1B:
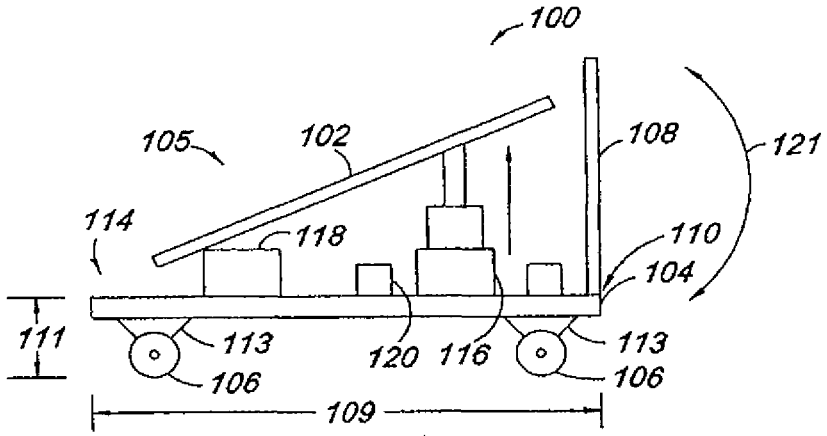
Figure 1C:
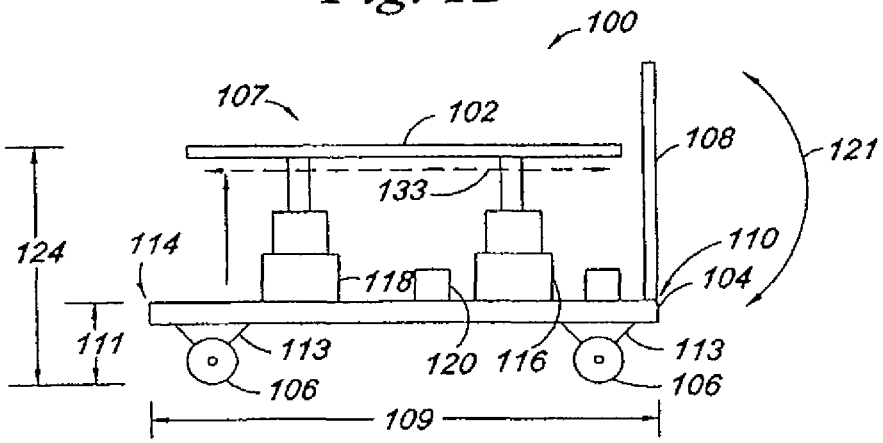

FIGS. 1A-1C illustrate an elevation plan view of some embodiments of a leg elevating device 100 according to the present disclosure.

FIG. 1A illustrates an embodiment of the leg elevating device 100 where the leg support platform 102 is in the first horizontal position 103, FIG. 1B illustrates an embodiment of the leg elevating device 100 where the leg support platform 102 is in an angled position 105, and FIG. 1C illustrates an embodiment of the leg elevating device 100 when the leg support platform 102 is in the second horizontal position 107.

In some embodiments the leg support platform 102 can be formed of a plastic material. For example, the leg support platform 102 can be formed of polyvinyl chloride (PVC), high density poly ethylene (HDPE), low density polyethylene (LDPE), and/or Polyethylene Terephthalate (PETE). Other materials for the leg support platform 102 are also possible.

For example, in one embodiment, the leg support platform 102 can be formed of metal, metal-alloy, wood, glass, and/or ceramic.

In some embodiments, the leg support platform 102 can be in the shape of a square. In various embodiments the leg support platform 102 can have other shapes including, but not limited to, rectangular, circular, ovular, diamond-shaped, and/or triangular. In addition, embodiments of the leg support platform 102 can have various dimensions. In some embodiments, the leg support platform 102 has a length and a width approximately equal to twenty-four (24) inches, and a height approximately equal to one (1) inch. The leg support platform 102 can also have other lengths and widths, as discussed herein.

Figure 1D:
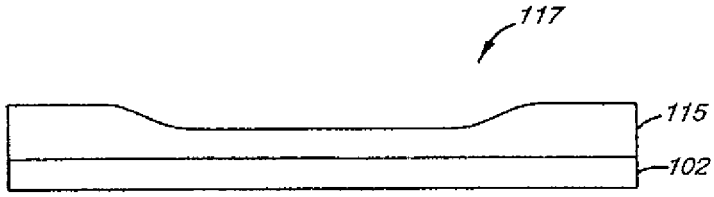
FIG. 1D illustrates a cross-sectional view of one embodiment of the leg support platform according to the present disclosure.

FIG. 1D illustrates a cross-sectional view of the leg support platform 102. In some embodiments, the leg elevating device can include a layer of material 115 attached to the leg support platform 102 that can be used to cushion the leg support platform 102 and/or to provide for easily identifiable leg placement markers 117 for the user. For example, the layer of material 115 can be U-shaped to provide a place for both legs. On the other hand, in some embodiments, the layer of material 115 can include two separate leg placement markers 117 to provide a place for each individual leg. In such embodiments, the leg placement markers 117 can show the user where to place their legs before using the leg elevating device 100.

In some embodiments, the layer of material 115 can have a thickness ranging from one-half (0.5) inch to three (3) inches. Embodiments of the layer of material 115 can be formed of such materials as polyurethane memory foam, Styrofoam, and/or rubber, among other materials. In addition, in some embodiments, the layer of material 115 can also include a moisture-proof covering to protect the layer of material 115 and/or to increase its durability.

As illustrated in FIGS. 1A-1C, in some embodiments the leg elevating device 100 can include a base platform 104. In such embodiments, the base platform 104 can be positioned adjacent the leg support platform 102. Embodiments of the base platform 104 can be formed of several different materials. For example, the base platform 104 can be formed of metal, metal-alloy, plastic, and/or wood, among other materials. In addition, in some embodiments, the base platform 104 can have a length 109 ranging from twenty (20) inches to forty (40) inches and a height 111 ranging from one-half (0.5) inch to two (2) inches. Also, in some embodiments, the base platform 104 can include a receiving member to receive a retractable handle to increase the portability of the leg elevating device 100, as discussed herein.

In addition, in various embodiments, the base platform 104 can include at least one wheel 106 coupled to the base platform 104 to make the leg lifting device 100 easily movable and/or portable. In some embodiments, the base platform can include at least four wheels 106 coupled to the base platform 104. In some embodiments, the wheels 106 can be in the form of a caster assembly where a small wheel 106 has the ability to swivel and is coupled to the base platform 104 to make the leg elevating device 100 easy to move. In addition, in such embodiments, the wheels 106 can include a brake mechanism 113 to lock the wheels 106 into place.

In some embodiments, the base platform 104 can include a location where a handle 108 can be releasably and/or pivotably connected on one end 112 of the base platform 104. In such embodiments, the handle 108 can be used to push and/or pull the leg elevating device 100 into position to use the leg elevating device 100. For example, the handle 108 can be used to position the leg elevating device 100 next to a bed. To facilitate the positioning of the leg elevating device 100 using the handle, in some embodiments the handle 108 can move (e.g., pivot and/or rotate) relative the base platform 104 as shown with arrow 121.

Additionally, the handle 108 can be used to move the leg elevating device 100 out of the way when the leg elevating device 100 is not in use. For example, the handle 108 can be used to push and/or pull the leg elevating device 100 to the head of a bed so that a user will not stumble on the leg elevating device 100 while getting out of a bed. In various embodiments, the handle 108 can also be used to lock and/or unlock the wheels 106 to fix the leg elevating device's 100 position either while in use and/or while the leg elevating device 100 is not being used.

As illustrated in FIGS. 1A-1C, in one embodiment, the handle 108 can be attached to the leg elevating device 100 at a site 110 on one end 112 of the base platform 104. In one embodiment, the handle 108 can be releasably coupled to the base platform 104. As used herein, "site" refers to a place on the leg elevating device 100 where the handle 108 can be releasably coupled to the leg elevating device 100. In various embodiments, the handle 108 can be attached to the leg elevating device 100 at a second end 114 of the leg elevating device 100. In some embodiments, the leg elevating device 100 can have more than one site 110 where the handle 108 can be attached to the leg elevating device 100.

The handle 108 can releasably couple to the leg elevating device 100 in a number of ways. For example, the handle 108 can releasably couple to the leg elevating device 100 by providing a threaded opening in the base platform 104 and a complimentary threaded end on the handle 108. Other ways to releasably couple the handle 108 to the leg elevating device 100 are also possible.

In one embodiment, the handle 108 can be a circular rod with a height ranging from thirty (30) inches to forty-two (42) inches. The handle 108 can also have different cross-sectional shapes such as a square, oval, ellipse, or triangle. In addition, in some embodiments the handle 108 can be formed of a metal, metal-alloy, glass, wood, plastic, or the like. The handle 108 can also be formed of different materials.

Figure 1E:
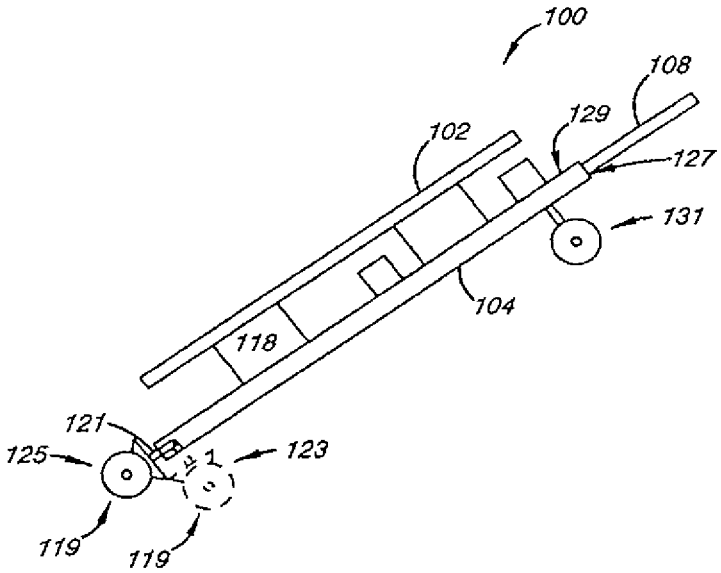

FIG. 1E illustrates an elevational plan view of an embodiment of the leg elevating device 100 according to the present disclosure. In some embodiments, the front wheels 119 positioned near the second lift 118 can be coupled to a lockable bracket 121. In some embodiments, the lockable bracket 121 can pivot around a pivot point so that the front wheels 119 move from a first wheel position 123 to a second wheel position 125. In some embodiments, the first wheel position 123 can be when the front wheels 119 are underneath the base platform 104. In some embodiments, the second wheel position 125 can be when the front wheels 119 are adjacent the base platform 104. In some embodiments, the back set of wheels 131 can be coupled to the base platform 104 such that the back set of wheels 131 are of approximately equal height to the front set of wheels 119 when in the first position 123.

As illustrated in FIG. 1E, when the front wheels 119 are in the second wheel position 125 the leg elevating device 100 can be tilted so that the front wheels 119 support the weight of the leg elevating device 100, and the leg elevating device 100 is easily moveable.

As discussed herein, the handle 108 can move (e.g., pivot and/or rotate) relative the base platform 104. In some embodiments, the handle 108 can move between an upright position where the handle 108 can be perpendicular the base platform, as shown in FIGS. 1A-1C, and a horizontal position, as shown in FIG. 1E, where the handle 108 is parallel the base platform 104. In some embodiments, the handle 108 can be retractable into a receiving member 127 positioned adjacent a base platform 104 member 129. In some embodiments, the handle 108 can be retracted into the receiving member 127 to at least one fixed position when the handle 108 is in the horizontal position. In some embodiments, the handle 108 can be retracted completely into the receiving member 127 to allow the leg elevating device 100 to be stored.

As discussed herein, a front set of wheels 119 can be coupled to a lockable bracket 121 that pivots around a pivot point. In some embodiments, the leg elevating device 100 includes the front set of wheels 119 coupled to the lockable bracket 121 and the handle 108 that can be retracted into a receiving member 127 when the handle 108 is in a horizontal position. In some embodiments, when the front set of wheels 119 are in the second position 125, the lockable bracket 121 can lock the front set of wheels 119 into the second position 125, and the handle 108 can be retracted to a fixed position in the receiving member 127. As illustrated in FIG. 1E, in some embodiments, the leg elevating device 100 can be portable, and can be transported between residences while a user is traveling.

In some embodiments, the leg elevating device 100 can include power driven wheels 106 (e.g., electrically powered) controlled via a remote control device. In such embodiments, the driving mechanisms for the wheels 106 are typically electric motors actuated by servos, belts, and gears. Embodiments using power driven wheels 106 can move the leg elevating device 100 so that it abuts the side of a bed while the leg elevating device 100 is in the second horizontal position, making it easier for the user to slide their lower legs directly onto a bed.

As discussed herein, the leg elevating device 100 can have a leg support platform 102 that moves between a first horizontal position 103, an angled position 105, and a second horizontal position 107. In one embodiment, the leg support platform 102 is coupled to the base platform 104 via a first lift 116 and a second lift 118. As used herein, "lift" refers to a device designed to raise something. In some embodiments, the leg elevating device 100 can include additional lifts. For example, if the leg elevating device were equipped with an additional leg support platform to lift the left leg and right leg separately, the additional leg support platform could be moved between the horizontal and angled positions using two additional lifts.

In addition, in some embodiments, the leg elevating device 100 can include additional lifts depending on the shape of the leg support platform 102. For example, in some embodiments, the leg support platform 102 can have a circular shape. In this example, the leg elevating device 100 can include four lifts positioned in a diamond shaped pattern so that the leg support platform 102 is well-balanced from each side. Other combinations of leg support platform 102 shapes and the number of lifts are also possible. In addition, the leg support platform 102 can also vacillate in a controlled manner, using, for example, a hydraulic pump coupled to an electric motor. Other ways to control the vacillation movement are also possible.

In some embodiments, the leg support platform 102 can be coupled to the first lift 116 and second lift 118 such that the leg support platform 102 can vacillate around a center axis 133 of the leg support platform 102 that runs between the first lift 116 and the second lift 118 of the leg support platform 102. In such embodiments, the leg support platform 102 can be coupled to the first and second lift 116, 118 using hinges to limit the range of vacillation of the leg support platform 102. For example, the hinges can allow for a side of the leg support platform 102 to move downward one (1) inch, while the opposite side of the leg support platform 102 moved upward one (1) inch. Other values for the range of vacillation are also possible. In some embodiments, the range of vacillation can depend on the depth of the leg placement marker on the layer of material overlying the leg support platform 102, as discussed herein with respect to FIG. 1D. Other methods of coupling the first and second lift 116, 118 to allow for vacillation around a center axis 133 are also possible.

As illustrated in FIGS. 1A-1C, the first lift 116 and second lift 118 can be coupled to the leg support platform 102 and the base platform 104. In one embodiment, the first lift 116 and second lift 118 can be coupled to the leg support platform 102 using a mechanical linkage between the leg support platform 102 and each of the first lift 116 and second lift 118 independently. Embodiments using a mechanical linkage allow the leg support platform 102 to move from a first horizontal position 103 as shown in FIG. 1A to an angled position 105 as shown in FIG. 1B. Therefore, in such embodiments, the mechanical linkage can allow the leg support platform 102 to move from an angle of approximately zero (0) degrees relative to the base platform 104 when the leg support platform is in the first horizontal position 103, to an angle of approximately forty-five (45) degrees relative to the base platform 104 when the leg support platform 102 is in the angled position 105, and to an angle of approximately zero (0) degrees relative to the base platform 104 when the leg support platform 102 is in the second horizontal position 107.

FIGS. 1A-1C illustrate various embodiments of the leg elevating device 100 where the first and second lift 116, 118 can move from a first position as shown in FIG. 1A to a second position as shown in FIGS. 1B and 1C pneumatically. For example, the first and second lift 116, 118 can include a pneumatic cylinder in each of the first lift 116 and second lift 118, capable of developing pneumatic pressure to support the leg support platform 102 at a desired height and angle. In addition, in this embodiment, the first lift and second lift 116, 118 can include means for selectively releasing the pneumatic pressure and storing the resulting pneumatic fluid flow outside the pneumatic cylinder, allowing the user to set the height of the first and second lift 116, 118, and then locking the first and second lift 116, 118 into the intended position. In some embodiments, the pneumatic cylinders inside the first and second lift 116, 118 can have a thirty (30) inch stroke and a pushing force of approximately three hundred (300) pounds. In various embodiments, hydraulic cylinders having a similar capability can be used.

In some embodiments, the leg elevating device 100 can include a hydraulic cylinder in each of the first and second lift 116, 118, as discussed herein, as well as a power system. For example, the hydraulic cylinder can be controlled by an electrically energized hydraulic power system including an electric motor 120 and control box 122 to cause the first and second lifts 116, 118 to move upwardly and downwardly from the first position to the second position, as discussed herein. Other control and actuation systems can be used in various embodiments as desired such as an electric motor without the use of hydraulic or pneumatic cylinders, for example.

In some embodiments, the electric motor 120 can be a motor powered by at least one rechargeable battery. In some embodiments, a charger can be included with the leg elevating device 100, such that the charger can be releasably coupled to the leg elevating device 100 to charge the rechargeable battery. In some embodiments, the charger can be of an appropriate size to be locatable under furniture. In such embodiments, the leg elevating device 100 can be guided back to the charger using a remote device, as discussed herein.

In some embodiments, the leg elevating device 100 can be programmed to return to the charger automatically when the at least one rechargeable battery reaches a defined lower limit of stored energy.

In some embodiments, the electric motor 120 can be a battery powered motor. Additionally, in various embodiments, the electric motor 120 can be powered via an electrical connection to an electrical wall socket. Other types of motors can also be used.

As discussed herein, the leg support platform 102 can move from a first horizontal position 103, to an angled position 105, and to a second horizontal position 107 as illustrated in FIGS. 1A-1C. As shown in FIG. 1A, when embodiments of the leg elevating device 100 are in the first horizontal position 103 the height 124 of the leg elevating device 100 can range from four (4) inches to ten (10) inches. In various embodiments, as the first lift 116 moves from the first position as shown in FIG. 1A to the second position as shown in FIG. 1B, the leg support platform 102 goes from a first horizontal position 103 to an angled position 105 relative the base support platform 104.

As shown in FIG. 1B, embodiments of the leg elevating device 100 can have a leg support platform 102 in an angled position. In some embodiments, the angle of the leg support platform 102 relative the base platform 104 can be in the range of thirty-five (35) degrees to fifty-five (55) degrees.

In some embodiments, the second lift 118 can move from a first position, as shown in FIGS. 1A and 1B to a second position, as shown in FIG. 1C. As the second lift 118 moves from first position to the second position, embodiments of the leg elevating device 100 can have the leg support platform 102 at the second horizontal position 107, as shown in FIG. 1C. In such embodiments, the height 124 of the leg elevating device 100 when in the second horizontal position 107 can range from twenty-five (25) inches to thirty-five (35) inches. Embodiments, however, are not limited to these examples.

In some embodiments, the leg elevating device 100 is configured to move from the first horizontal position 103 as shown in FIG. 1A to the angled position 105, shown in FIG. 1B at a rate of about two (2) to three (3) degrees for every one (1) inch raised in height. Similarly, in some embodiments, the leg elevating device 100 can move from the angled position 105, shown in FIG. 1B, to the second horizontal position 107, shown in FIG. 1C, at a rate of about two (2) to three (3) degrees for every one (1) inch raised in height. In addition, in various embodiments, the entire cycle time with which the leg elevating device 100 can move from the first horizontal position 103, to the angled position 105, to the second horizontal position 107, and back to the first horizontal position 103 can range from three (3) minutes to five (five) minutes. Exemplary speeds for the leg elevating device, therefore, can range from nine (9) inches per minute to thirty-one (31) inches per minute.

Figure 2A:
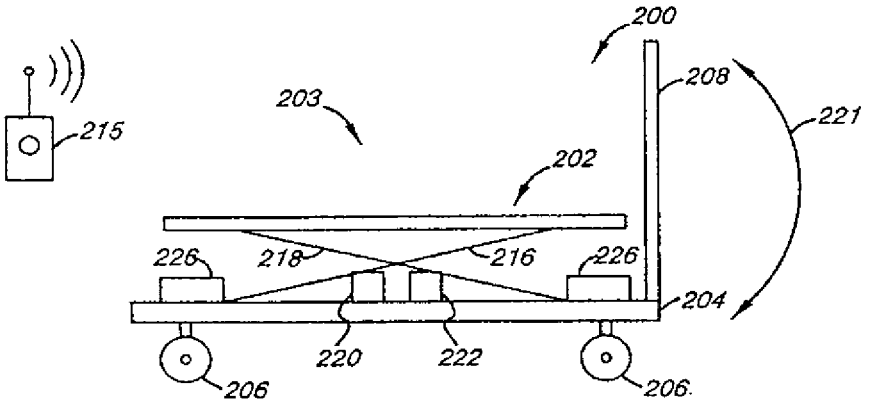
FIGS. 2A-2C illustrate a plan view of one embodiment according to the present disclosure.
Figure 2B:
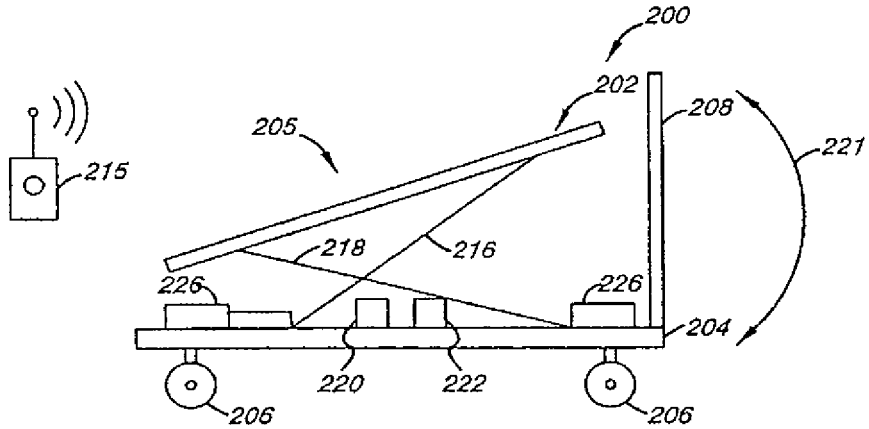
Figure 2C:
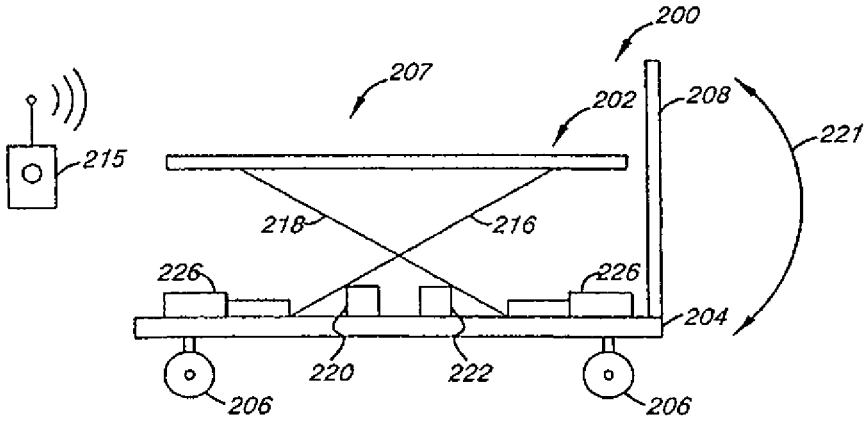

FIGS. 2A-2C illustrate an elevation plan view of various embodiments of a leg lifting device 200 according to the present disclosure. As illustrated, in this embodiment the leg lifting device 200 includes a leg support platform 202, a base platform 204, a handle 208, and wheels 206 as discussed herein. In some embodiments, the first and second lift 216, 218 can be positioned between the leg support platform 202 and base platform 204 and coupled to the leg support platform 202 and base platform 204, as discussed herein. In such embodiments, the first and second lift 216, 218 can move from a first position to a second position as shown in FIGS. 2A-2C. FIG. 2A shows the first and second lift 216, 218 in the first position and the leg support platform 202 in the first horizontal position 203. As the first lift 216 moves from the first position to the second position, as shown in FIG. 2B, embodiments of the leg elevating device 200 can include the leg support platform 202 in an angled position 205 relative the base platform 204. Additionally, as the second lift 218 moves from the first position to the second position, as shown in FIG. 2C, embodiments of the leg elevating device 200 can include the leg support platform 202 in a second horizontal position 207 relative the base platform 204.

In some embodiments, the leg elevating device 200 can include a hydraulic cylinder 226 adjacent each of the first and second lifts 216, 218. In such embodiments, the hydraulic cylinder 226 can be controlled by an electrically energized hydraulic power system including an electric motor 220 and control box 222. Embodiments including an electrically energized hydraulic power system can cause the first and second lifts 216, 218 to move horizontally on the base platform 204 to cause the leg support platform 202 to move upward and downward between the first horizontal position 203, the angled position 205, and the second horizontal position 207, as discussed herein. Other control and actuation systems can also be used as desired such as a pneumatic system, for example. In addition, in some embodiments, the control and actuation systems can include rack-and-pinion systems and/or nut-and-spindle systems connected to an electric motor 220 and a control box 222.

In some embodiments, the first and second lifts 216, 218, the hydraulic cylinders 226, the electric motor 220, and the control box 222 are enclosed in a hard plastic shell to prevent damage to the mechanisms. In addition, the moving parts can be enclosed to prevent injury to the user and/or other individuals standing near the leg elevating device 200. In some embodiments, the leg elevating device 200 including the plastic shell can have a weight in the range of five (5) to fifteen (15) pounds. In addition, in some embodiments, the leg elevating device 200 can be accompanied by a traveling sleeve to protect the device during travel, and also to provide the user with some level of privacy when transporting the leg elevating device 200 in public.

In some embodiments, the leg elevating device 200 can include a sensor on the base platform 204 inside the control box 220 to actuate the movement of the first lift 216 and second lift 218 from the first position to the second position. In such embodiments, a remote device 215 can be used to actuate the base platform 204 sensor. Also, in some embodiments, the control box 220 can include a receiver to receive the signal transmitted from the remote device 215.

In some embodiments, the remote device 215 can include a transmitter to send a signal to the sensor on the base platform 204. As such, when the transmitter in the remote device 215 is actuated, a signal can be transmitted to the sensor, indicating an activation of the remote device. Once the signal is received, the sensor can actuate the movement of the first lift 216 and second lift 218 from the first position to the second position. In some embodiments, the sensor is configured so that the first activation of the remote device 215 actuates the movement of the first lift 216 from the first position to the second position. In such embodiments, the second activation of the remote device 215 can then actuate the movement of the second lift 218 from the first position to the second position, and the third activation of the remote device 215 can also then actuate the movement of the first and second lift 216, 218 from the second position to the first position. Other movements can also be controlled using the remote device, including other sequences of movements.

In some embodiments, the control box 220 can include a radio frequency range wireless receiver with an antenna for receiving a radio frequency range control signal from a transmitter in a remote device 215. In such embodiments, the transmitter can be provided with an antenna for emitting radiation in the radio frequency range for reception by the receiver. The receiver and the transmitter can both be of a type commercially available and suitable for remote control operation for up to approximately twenty (20) feet operating range between the transmitter and the receiver. In some embodiments, the receiver and transmitter can communicate using infrared. In one embodiment, the control box 220 is connected to the remote device 215 via a wire that can have a length ranging from three (3) feet to seven (7) feet.

Figure 3A:
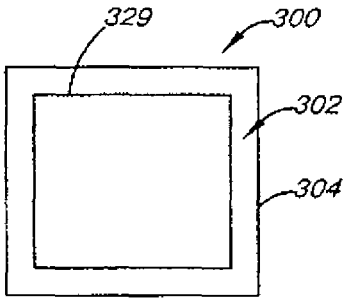
FIGS. 3A-3E show a top view of embodiments according to the present disclosure.

FIGS. 3A-3E illustrate a top view of various embodiments of the leg elevating device 300. The various leg support platforms 302 shown in FIGS. 3A-3E can be implemented as leg support platforms 102 and 202 in FIGS. 1 and 2. As discussed herein, the leg support platform 302 can have various shapes and dimensions. In FIG. 3A, the leg support platform 302 is a square platform. In this embodiment, the leg support platform 302 can have a length and width 329 in the range of twelve (12) inches to thirty (30) inches.

Figure 3B:
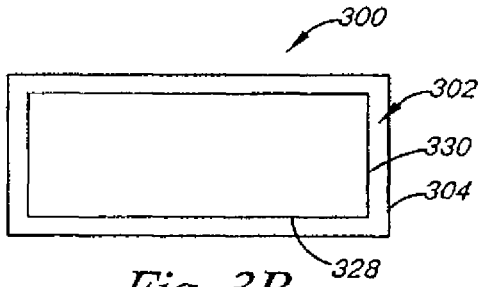
Figure 3C:
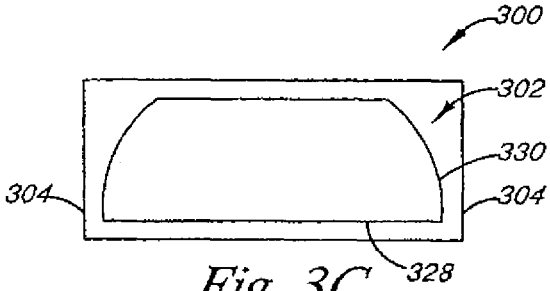

FIGS. 3B and 3C illustrate additional embodiments of the leg support platform 302. FIG. 3B illustrates the leg support platform 102 having a rectangular shape. Similarly, FIG. 3C illustrates the leg support platform 302 having a rectangular shape but with curved sides. The leg support platform 302 can have a length 328 in the range of twenty (20) inches to thirty (30) inches, and a width 330 in the range of twelve (12) inches to twenty (20) inches.

Figure 3D:
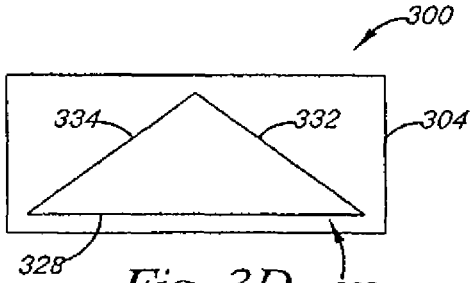

In some embodiments, the leg support platform 302 can be in the shape of a triangle, as shown in FIG. 3D. In such embodiments, the leg support platform 302 can have a length 328 in the range of twenty (20) inches to thirty (30) inches, and a height 334, 332 in the range of fourteen (14) inches to twenty-two (22) inches.

Figure 3E:
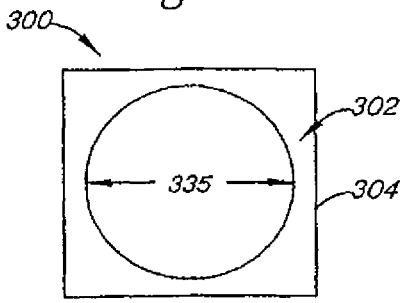

FIG. 3E is an illustration of an embodiment of the leg support platform 302 with a circular shape. In such embodiments, the leg support platform 302 can have a diameter 335 in the range of twelve (12) to thirty (30) inches.

Additionally, although the base platform 304 is shown in FIGS. 3A-3D having a rectangular shape, in some embodiments the base platform 304 can have a circular, triangular, oval, or polygonal shape. In addition, in some embodiments, the base platform 304 can have a different shape than the leg support platform 302.

Figure 4A:
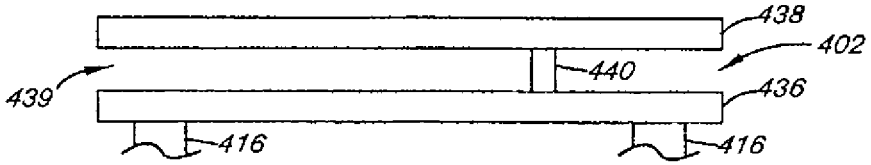
FIG. 4A illustrates a plan view of one embodiment according to the present disclosure including a second leg support platform.
Figure 4B:
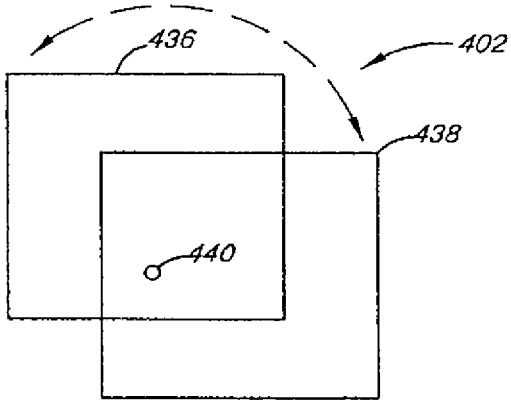
FIG. 4B illustrates a top view of the embodiment shown in FIG. 4A.

FIGS. 4A-4B illustrate an embodiment of a leg support platform 402 having a first component 436 and a second component 438 according to the present disclosure. In various embodiments, the first component 438 of the leg support platform 402 can be the leg support platform 102, 202, and 302 shown in FIGS. 1-3. FIG. 4A illustrates a side view of an embodiment of the first component 436 and a second component 438 to the leg support platform 402.

FIG. 4B illustrates a top view of an embodiment of the first component 436 and a second component 438 to the leg support platform 402. In some embodiments, the first component 436 of the leg support platform 402 is fixed to the first and second lifts 416, 418, as discussed herein, and a second component 438 to the leg support platform 436 can rotate relative to the first component 436. In such embodiments, the user can place his or her legs onto the second component 438. Once the leg elevating device is in the second horizontal position, the second component 438 can rotate so that the second component 438 is in a different position relative the first component 436, and the user can then move his or her legs onto a bed.

In various embodiments, the second component 438 to the leg support platform 402 can be connected to the first component 436 of the leg support platform 402. Embodiments including a second component 438 to the leg support platform 402 can have the second component 438 positioned above the first component 436 with a gap 439 between the two components 436, 438.

As discussed herein, in some embodiments, the second component 438 to the leg support platform 402 can be connected to the first component 436 of the leg support platform 402. For example, the second component 438 can be pivoted on turret 440 while the turret 440 remains fixed, e.g, at a stationary location relative to the base platform of the leg elevating device, in order to move the user's lower legs closer to a bed. In various embodiments, the user can control the rotation of the second component 438 on turret 440 using a remote device. Embodiments including a second component 438 rotated on turret 440 can use an electric motor and actuators to move the second component 438. In addition, embodiments including a second component 438 can be configured such that the gap 439 between the two components 436, 438 is maintained while the leg elevating device is in use. In various embodiments, the leg elevating device can be designed to support at least three hundred (300) pounds on the second component 438 while maintaining the gap 439 between the two components 436, 438.

FIG. 4B illustrates an embodiment where the second component 438 has been rotated on the turret 440 in a clockwise direction while the first component 436 remains stationary. In some embodiments, the second component 438 can be rotated on the turret 440 in a counterclockwise direction while the first component 436 remains stationary. The embodiments described in relation to FIGS. 4A and 4B can be incorporated into the leg elevating devices as described herein, including those described with respect to FIGS. 1A-1C and FIGS. 2A-2C.

Figure 5A:
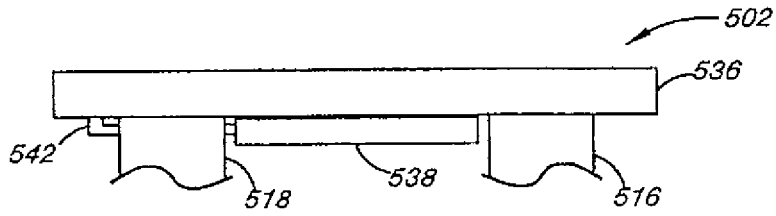
FIG. 5A illustrates a plan view of one embodiment according to the present disclosure including a second leg support platform.
Figure 5B:
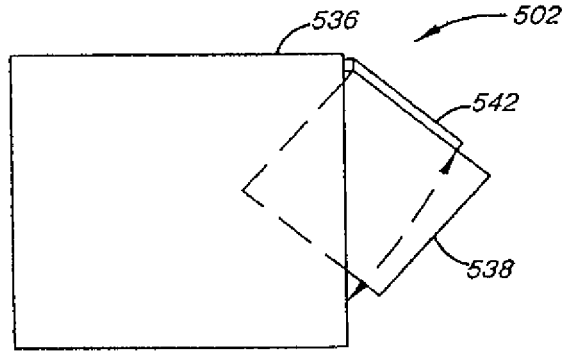
FIG. 5B illustrates a top view of the embodiment shown in FIG. 5A.

FIGS. 5A-5B illustrate an embodiment of a leg support platform 502 having a first component 536 and a second component 538 according to the present disclosure. FIG. 5A illustrates a side view of an embodiment of the first component 536 and a second component 538 to the leg support platform 502.

FIG. 5B illustrates a top view of an embodiment of the first component 536 and a second component 538 to the leg support platform 502. In some embodiments, the first component 536 of the leg support platform 502 is fixed to the first and second lifts 516, 518, as discussed herein, and a second component 538 can swing from the first component 536 using a swing arm 542 coupled to the first component 536 of the leg support platform 502. In such embodiments, the user can place his or her legs onto the first component 536. Once the leg elevating device is in the second horizontal position, the second component 538 can swing out so the user can move his or her legs over onto a bed.

In some embodiments, the swing arm 542 can be a telescoping arm. In some embodiments, the swing arm 542 can be formed of metal, metal-alloy, composite material, and/or plastic, among other materials. In addition, in various embodiments, the swing arm 542 can be formed such that it can withstand up to at least a three hundred (300) pound force without bending.

In some embodiments, the second component 538 can be coupled to the first component 536 of the leg support platform 502. Embodiments including a second component 538 can have the second component 538 positioned below the first component 536. In various embodiments, the second component 538 can be connected to the first component 536 with a swing arm 542 that is capable of rotating at least one hundred eighty (180) degrees relative the first component 536 of the leg support platform 502. In addition, in such embodiments, the user can control the rotation of the second component 538 using a remote device. Embodiments including a second component 538 attached to a swing arm 542 can use an electric motor and actuators to move the second component 538. Also, embodiments including a second component 538 positioned below the first component 536 can be designed so that the second component 538 can be positioned between the first and second lifts 516, 518 and not interfere with the operation of the first and second lifts 516, 518.

FIG. 5B illustrates an embodiment where the second component 538 has been positioned (e.g., in a swing or rotating motion) at the right side of the first component 536 using the swing arm 542 while the first component 536 remains stationary. In some embodiments, the second component 538 can be attached to the first component 536 on the right side of the first component 536. The embodiments described in relation to FIGS. 5A and 5B can be incorporated into the leg elevating devices as described herein, including those described with respect to FIGS. 1A-1C and FIGS. 2A-2C.

Figure 6A:
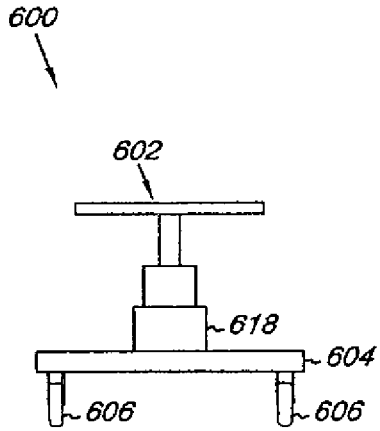
FIG. 6A illustrates an end view of one embodiment of the present disclosure in which the leg support platform of the leg elevating device is in the second horizontal position.

FIG. 6A illustrates an end view of one embodiment of the present disclosure, such as the embodiment illustrated in FIG. 1C, in which leg support platform 602 of leg elevating device 600 is in the second horizontal position. In some embodiments, leg support platform 602 is coupled to base platform 604 via lift 618, as discussed herein. In some embodiments, base platform 604 includes at least one wheel 606, as discussed herein. Although not shown in FIG. 6A for ease of illustration, leg elevating device 600 can also include a handle, such as handle 108 shown in FIG. 1, as discussed herein.

Figure 6B:
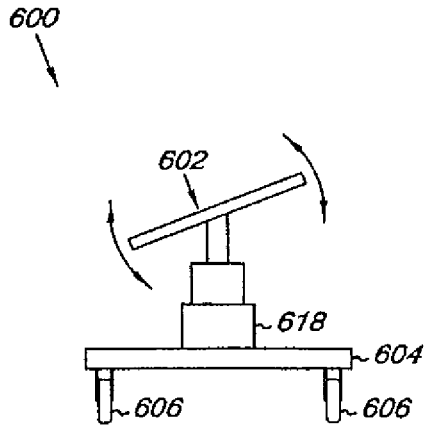
FIG. 6B illustrates an end view of the embodiment shown in FIG. 6A in which the leg support platform is vacillating around a center axis of the leg support platform while the leg support platform is in the second horizontal position.

FIG. 6B illustrates an end view of the embodiment shown in FIG. 6A in which leg support platform 602 is vacillating around a center axis, e.g., center axis 133 shown in FIG. 1, of leg support platform 602 while leg support platform 602 is in the second horizontal position. The embodiments described in relation to FIGS. 6A and 6B can be incorporated into the leg elevating devices as described herein, including those described with respect to FIGS. 1A-1C and FIGS. 2A-2C.

In some embodiments, the leg elevating device can be equipped with more than one leg support platform to enable the right and left leg of the user to be lifted separately. In such embodiments, the first lift and second lift would work as discussed herein in that the first lift and second lift would move from a first position to a second position. However, the leg elevating device could also include a third lift and a fourth lift, as discussed herein, to move from a first position to a second position to enable the additional leg support platform to move from a first horizontal position, to an angled position, and to a second horizontal position, as discussed herein, separately from the original leg support platform. In some embodiments, the leg elevating device can also use more than two leg support platforms.

While the present disclosure has been shown and described in detail, changes and modifications may be made without departing from the scope of the disclosure. As such, that which is set forth in the foregoing description and accompanying drawings is offered by way of illustration only and not as a limitation. In addition, various features may have been grouped together in several embodiments for the purpose of streamlining the disclosure. This method of disclosure is not to be interpreted as reflecting an intention that the embodiments of the disclosure require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A leg elevating device, comprising:

a leg support platform to elevate a leg of a user;

a base platform positioned adjacent the leg support platform; and a first lift and a second lift positioned between and coupled to the leg support platform and the base platform, wherein:

the leg support platform has a first horizontal position relative the base platform when the first lift and the second lift are in a first position, wherein the leg support platform is a predetermined height above a floor surface when in the first horizontal position, such that the leg elevating device is locatable under furniture;

the leg support platform has an angled position relative the base platform when the first lift is in a second position and the second lift is in the first position; and the leg support platform has a second horizontal position relative the base platform when the first lift and second lift are in the second position, wherein the leg elevating device is entirely separate and nonattached from a bed.

2. The leg elevating device of claim 1, wherein the leg support platform includes:

a first component coupled to the first and second lifts; and a second component coupled to the first component and positioned adjacent the first component, wherein the second component can rotate relative the base platform such that the user can move the leg from the leg support platform to the bed.

3. The leg elevating device of claim 1, wherein the leg support platform can rotate relative the base platform such that a surface area associated with the leg support platform is increased.

4. The leg elevating device of claim 1, wherein the first lift and second lift include at least one hydraulic cylinder to move the first lift and second lift between the first position and the second position and the first lift and second lift include an electrical motor and an associated control system to control actuation of the at least one hydraulic cylinder.

5. The leg elevating device of claim 1, wherein the base platform includes a handle releasably coupled to the base platform.

6. The leg elevating device of claim 5, wherein the handle can move between an upright position and a horizontal position, wherein the handle is parallel the base platform when in the horizontal position.

7. The leg elevating device of claim 6, wherein the handle is retractable into a receiving member positioned adjacent a base platform member to at least one fixed position when in the horizontal position.

8. The leg elevating device of claim 1, wherein the leg support platform can be moved from the second horizontal position directly to the first horizontal position by moving the first lift and second lift from the second position to the first position approximately simultaneously.

9. A leg elevating device, comprising:

a leg support platform to elevate a leg of a user, wherein the leg support platform includes:

a first component; and a second component coupled to the first component and positioned adjacent the first component;

a base platform positioned adjacent the leg support platform; and a first lift and a second lift positioned between and coupled to the base platform and the first component of the leg support platform, wherein:

the leg support platform has a first horizontal position relative the base platform when the first lift and the second lift are in a first position, wherein the leg support platform is a predetermined height above a floor surface when in the first horizontal position, such that the leg elevating device is locatable under furniture;

the leg support platform has an angled position relative the base platform when the first lift is in a second position and the second lift is in the first position; and the leg support platform has a second horizontal position relative the base platform when the first lift and second lift are in the second position, wherein the leg elevating device is entirely separate and nonattached from a bed.

10. The leg elevating device of claim 9, wherein the second component of the leg support platform can rotate relative the first component of the leg support platform such that a surface area associated with the leg support platform is increased.

11. The leg elevating device of claim 9, wherein the second component of the leg support platform is positioned below the first component of the leg support platform.

12. The leg elevating device of claim 11, wherein:

the second component of the leg support platform is coupled to the first component of the leg support platform by a swing arm; and the swing arm can rotate relative the first component such that the second component rotates relative the base platform.

13. The leg elevating device of claim 12, wherein the swing arm can rotate 180 degrees relative the first component.

14. The leg elevating device of claim 11, wherein the second component is positioned between the first lift and the second lift when the leg support platform is in the first horizontal position.

15. The leg elevating device of claim 9, wherein the second component of the leg support platform is positioned above the first component of the leg support platform.

16. The leg elevating device of claim 9, wherein the second component of the leg support platform includes a leg placement marker.

17. The leg elevating device of claim 16, wherein the leg placement marker is a U-shaped layer of material attached to the second component of the leg support platform.

18. A method of operating a leg elevating device while a user is seated on a bed, comprising:

placing a leg support platform of the leg elevating device in a first horizontal position relative a base platform of the leg elevating device;

placing a leg of a user on the leg support platform while the leg support platform in the first horizontal position;

moving the leg support platform from the first horizontal position to an angled position relative the base platform;

moving the leg support platform from the angled position to a second horizontal position relative the base platform; and moving the leg of the user from the leg support platform to the bed while the leg support platform is in the second horizontal position, the leg support platform being entirely separate and nonattached from the bed.

19. The method of claim 18, wherein the method includes moving the leg of the user from the leg support platform to the bed by rotating the leg support platform relative the base platform and vacillating the leg support platform around a center axis of the leg support platform while the leg support platform is in the second horizontal position.

20. The method of claim 19, wherein the method includes moving the leg of the user from the bed to the leg support platform while the leg support platform is in the second horizontal position by rotating the leg support platform relative the base platform and vacillating the leg support platform around a center axis of the leg support platform while the leg support platform is in the second horizontal position.

* * * * *